United States Patent [19]

Pasquali et al.

[11] Patent Number: 5,011,431

[45] Date of Patent: Apr. 30, 1991

[54] BASEPLATE FOR SUPPORTING A PLURALITY OF ELECTRIC CONNECTORS ON A MOTOR CAR

[75] Inventors: Renato Pasquali, Garbagnate; Raffaele Drago, Milan, both of Italy

[73] Assignee: Alfa Lancia S.p.A., Arese, Italy

[21] Appl. No.: 462,050

[22] Filed: Jan. 8, 1990

[30] Foreign Application Priority Data

Jan. 10, 1989 [IT] Italy ..... 20422[U]

[51] Int. Cl.[5] ..... H01R 13/627

[52] U.S. Cl. ..... 439/540; 439/571

[58] Field of Search ..... 439/533, 540, 571, 34

[56] References Cited

FOREIGN PATENT DOCUMENTS 3045329 7/1982 Fed. Rep. of Germany ..... 439/34

*Primary Examiner*—Eugene F. Desmond

*Attorney, Agent, or Firm*—Charles A. Brown

[57] ABSTRACT

A baseplate for supporting electric connectors on a motor vehicle comprises a plurality of connector-supporting members protruding from a plate-like base casing, latching means being provided on the connectors and the connector-supporting members.

11 Claims, 1 Drawing Sheet

Fig.1
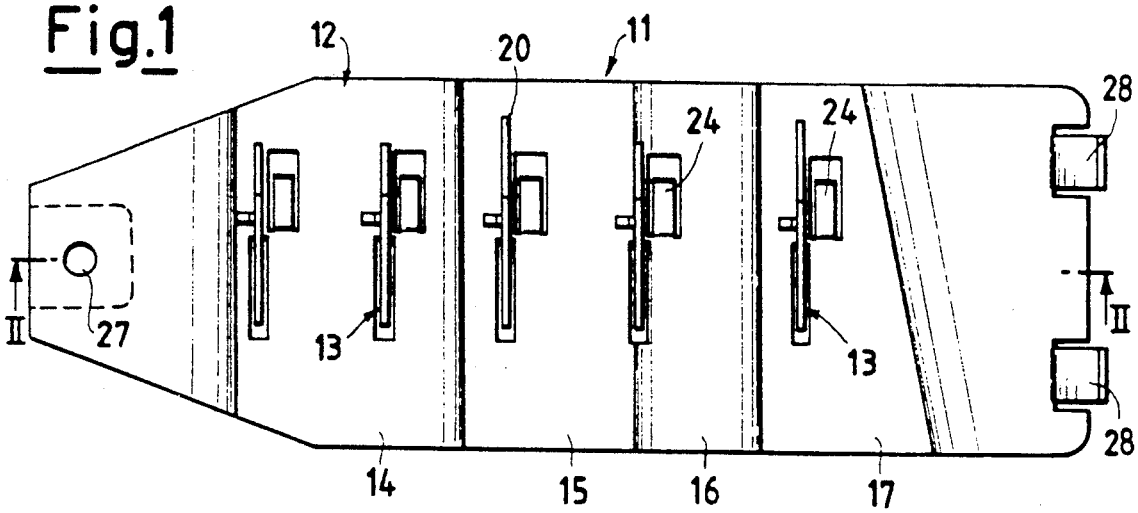
Fig.2
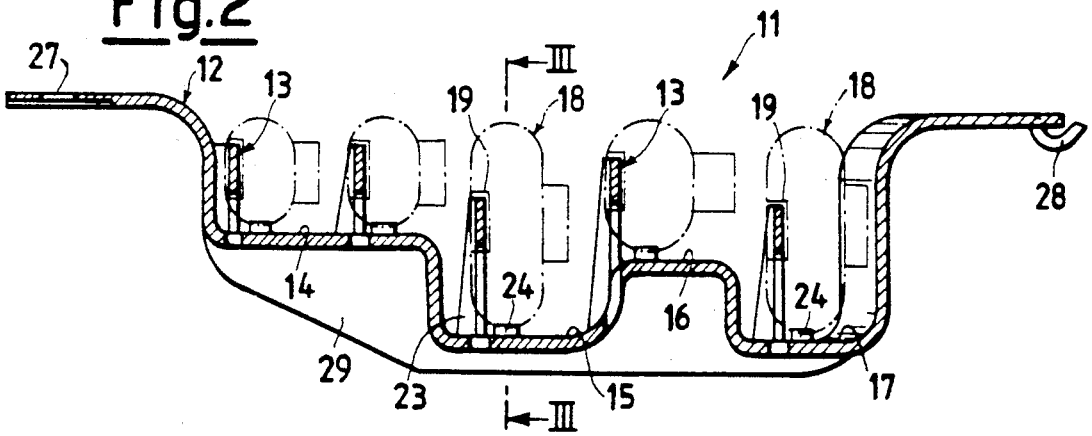
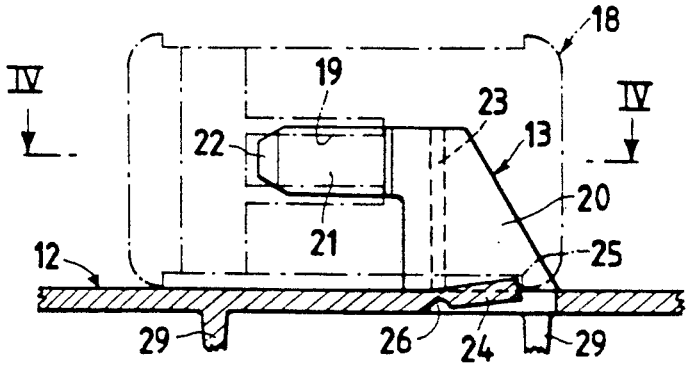
Fig.3
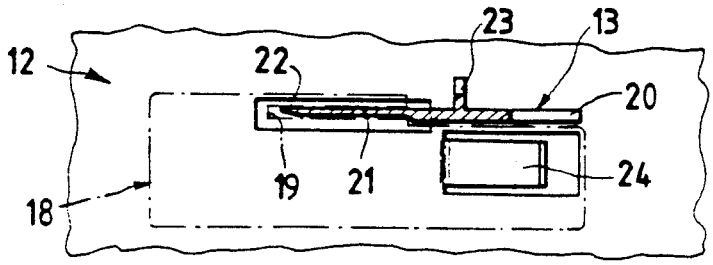
Fig.4

BASEPLATE FOR SUPPORTING A PLURALITY OF ELECTRIC CONNECTORS ON A MOTOR CAR

FIELD OF THE INVENTION

This invention relates to a baseplate for supporting a plurality of electric connectors, more particularly on board of a motor car, of the kind having first latching members, consisting of at least a cavity or a tag, and adapted to engage second latching means, these latter consisting of at least a tag or a cavity, respectively, these means being formed on a base which can be secured to a component part of the vehicle concerned.

BACKGROUND OF THE INVENTION

In motor car constructions, a long felt want is to be able to secure one or more electrical connectors to component parts of the vehicle, so as to achieve convenience both in installation and removal. At present, devices of the kind referred to above are used, in which the specially provided supporting tongues have, on either end, a knurled portion intended to be inserted into a likewise specially provided cavity of the connector, and, at the opposite end, a hole intended to receive a screw and a washer for securing the tongue aforesaid to the component part concerned of the vehicle.

Devices of the kind referred to above, which are based on the exploitation of a supporting tongue for each and every connector to be installed, require an assembling step for each individual connector.

Therefore, to position a set of connectors in the adjacency of each individual vehicle component part or member, such as a door, by sequentially installing the individual securing tongues into the connectors, is a cumbersome operation and originates troubles both in grouping the connectors and the electric leads fastened thereto.

It should also not be overlooked that the presence of a knurl on a tongue end is such that the withdrawal of a connector from its attendant tongue is not always a convenient manipulation.

OBJECTIVES OF THE INVENTION

An objective of the present invention is thus to solve the problems outlined above in order to provide a supporting base for electric connectors which is simple to build and easy to position and to remove, consistently with the individual motor car component part concerned.

Another objective is to provide a supporting base for electric connectors which is absolutely reliable as regards the way of fastening it to the motor car component concerned.

GENERAL DESCRIPTION OF THE INVENTION

Having the above outlined objectives in view, the present invention provides a supporting baseplate for electric connectors which are fitted with first latching means, said baseplate being characterized in that it consists of a plate-like base casing from which at least a connector-supporting member projects, which is fitted with second latching means, said base casing having formed thereon, in correspondence with said at least one connector-supporting member, a latching means for disconnectably securing the electric connector concerned to said base casing.

Preferably, said at least one connector-supporting member consists of at least one supporting tag, said latching means consisting of a wing-like projection extending from said base casing in order to engage an abutment formed on said electric connector.

Moreover, said plate-like base casing has an appropriately shaped outline for defining the seats for the supporting tongues and the connectors concerned.

BRIEF DESCRIPTION OF THE DRAWINGS

The properties and advantages of the device according to the invention will better be appreciated from the ensuing description of a preferred embodiment, as illustrated by the accompanying drawings, wherein:

FIG. 1 is a front view of the device according to the invention;

FIG. 2 is a cross-sectional view of the device, taken along the line II—II of FIG. 1;

FIG. 3 is an enlarged partial cross-sectional view of the device, taken along the line III—III of FIG. 2, and FIG. 4 is a cross-sectional view, taken along the line IV—IV of FIG. 3.

DESCRIPTION OF THE PREFERRED EMBODIMENT

Having reference, at the outset, to FIGS. 1 and 2, a device according to the invention is generally indicated at 11, and essentially comprises a base casing 12, substantially in the form of a plate, wherefrom plural connector-supporting members, 13, jut.

The plate-like base casing 12 has a shaped outline which is adapted to provide and to define a number of seats, exemplarily indicated in the number of four and connoted, in the example shown, by the numerals 14, 15, 16 and 17. The size of such seats can differ from any seat to any other, so as to be able to house electric connectors of various sizes: these latter are shown in phantom at 18 in the drawing, and the cables fastened thereto are not shown for the sake of clarity.

Each electric connector, 18, has, formed on a sidewall thereof, a chamber, shown at 19, into which the free end of a connector-supporting member, 13, can be inserted.

Each connector-supporting member, 13, has the shape of a bracket-like fixture, which has a widened root piece 20 for fastening the member to the plate-like base casing 12, and a supporting shank proper, 21, for receiving an electric connector, 18: the cross-sectional outline of 21 is rectangular and the end profile is tapered at 22 to facilitate insertion.

It is preferred that the connector-supporting member 13 is arranged perpendicularly to the plate-like base casing 12, and has, on at least a sidewall, a reinforcing rib, shown at 23, intended to facilitate a better retention of the mutually latched members in the correct work position.

Alongside each connector-supporting member, 13, the plate-like base casing 12 has a latching means intended to disconnectably fasten the electric connector 18 to said base casing: preferably, as shown in the drawings, said latching means is a wing-like projection, 24, protruding from the base casing 12 alongside the member 13, said wing-like projection 24 being intended to engage an abutment surface, 25, which should be formed on the electric connector, 18, concerned.

The wing 24 can be, for instance, rectangular and can be stamped out on three sides through the base casing and has a groove, 26, on its underside, to afford elastic yieldability thereto.

The plate-like base casing 12 is, as outlined above, so shaped as to define a number of connector-receiving seats in any desired number, and has, at one of its longitudinal ends, a securing hole 27, and, at the opposite end, at least a curled latching tab 28: the drawing shows these tabs 28 exemplarily in the number of two, which make it possible to secure the device to any component part of a motor car.

The presence of the curled tabs 28 makes it possible to snappingly position the device in question onto the component part concerned of the car, whereafter the device is finally secured in place by a screw, slipped into the bore 27, and a washer (not shown).

Preferably, the device according to the invention is fabricated apiece, for example as a moulded plastics article: in correspondence with its bottom surface, away of the face on which the connector-supporting members 13 project, the base-like plate 12 may have longitudinally running stiffening ribs such as 29.

It is understood that the device may also be embodied using different materials for the base casing and the connector-supporting members, or by forming the base casing and the latching means as a single piece and by positioning and securing the other component parts subsequently.

The use of the device according to this invention is easy to understand, since the electric connectors, which may be, for example, two-part couplings, are coupled and then snapped into position on their respective supporting members 13 by the agency of the chambers 19. During such a positioning run, the wing 24 snaps against the abutment 25 of 18, wherefore the latter is held stably in position.

Once that all the connectors have been secured to their common base casing, the latter is secured to the motor car body, or another component part, at choice. Matter-of-factly, by latching the curled tags 28 into a matching projection or seat on the car section concerned (not shown), it suffices to screwably set the other end of the base casing onto position.

By so doing, a fair grouping of both the electric connectors and their attendant electric inlet and outlet leads is achieved.

Such a mode of fastening warrants the reliability of both the mechanical and the electric connections: should it be necessary to dismantle the assembly from the motor car, this is both an extremely easy and convenient operation.

A device of the kind described hereinbefore is especially suitable for positioning a set of electric leads in the least accessible regions of a motor car, such as in the interior of a door, in the engine compartment and like hardly accessible places.

We claim:

1. A supporting baseplate for electric conductors for use on a motor car, each of the conductors having first latching means for securing the conductors to said baseplate, said baseplate comprising a plate-like base casing which can be secured to a component part of the car, said plate-like base casing having at least one connector-supporting member projecting generally perpendicular from said base casing, said at least one connector-supporting member having second latching means for cooperating with said first latching means of a respective connector to retain the respective connector, said base casing further having a third latching means in correspondence with said at least one connector-supporting member for disconnectably securing the respective connector to said base casing.

2. A supporting baseplate according to claim 1, wherein said third latching means is a wing-like projection jutting from said plate-like base casing to engage an abutment formed on the respective electric connector.

3. A supporting baseplate according to claim 1, wherein said third latching means and said base casing are formed as a single piece.

4. A supporting baseplate according to claim 1, wherein said plate-like base casing is fitted on at least one side with at least one securing bore and, on the opposite side, with at least one curled latching tab.

5. A supporting baseplate according to claim 1, wherein said at least one connector supporting member has at least one supporting tag.

6. A supporting baseplate according to claim 5, wherein said base casing and said at least one connector-supporting member are formed as a single piece.

7. A supporting baseplate according to claim 5, wherein a reinforcing rib is arranged on at least one side of said at least one connector-supporting member.

8. A supporting baseplate according to claim 5, wherein said plate-like base casing has, in correspondence with its surface away of that from which said at least one connector-supporting member protrudes, a reinforcing rib.

9. A supporting baseplate according to claim 5, wherein said at least one connector-supporting member has the shape of a bracket-like fixture, having a widened root piece for fastening the member to said plate-like base casing, and a supporting shank proper for the electric connectors, the cross-sectional outline of said supporting shank proper being rectangular, the end profile being tapered to facilitate insertion.

10. A supporting baseplate according to claim 5, wherein said plate-like base casing has a shaped outline for defining seats for connector-supporting members and attendant connectors.

11. A supporting baseplate according to claim 10, wherein said base casing is fitted with a plurality of connector-supporting members arranged within said seats and protruding at different levels from said plate-like base casing.

* * * * *